US010113835B1

(12) United States Patent
Stephenson

(10) Patent No.: US 10,113,835 B1
(45) Date of Patent: Oct. 30, 2018

(54) FIREARM AND AN ALIGNMENT AID

(71) Applicant: Allen Daniel Stephenson, Greenville, SC (US)

(72) Inventor: Allen Daniel Stephenson, Greenville, SC (US)

( * ) Notice: Subject to any disclaimer, the term of this patent is extended or adjusted under 35 U.S.C. 154(b) by 0 days.

(21) Appl. No.: 15/809,588

(22) Filed: Nov. 10, 2017

(51) Int. Cl.
*F41G 1/01* (2006.01)
*F41G 1/06* (2006.01)
*F41G 1/02* (2006.01)

(52) U.S. Cl.
CPC ..... *F41G 1/01* (2013.01); *F41G 1/02* (2013.01); *F41G 1/06* (2013.01)

(58) Field of Classification Search
CPC ..... F41G 1/01; F41G 1/02; F41G 1/06; F41G 1/08; F41G 1/10
See application file for complete search history.

(56) References Cited

U.S. PATENT DOCUMENTS 4,479,307 A * 10/1984 Pomeranz ..... F41G 1/26 42/133
6,058,616 A * 5/2000 Bubits ..... F41G 1/01 42/144
2007/0074441 A1* 4/2007 Howe ..... F41G 1/01 42/111

FOREIGN PATENT DOCUMENTS

DE 102013012819 * 2/2015

* cited by examiner

*Primary Examiner* — Stephen Johnson
(74) *Attorney, Agent, or Firm* — Steve LeBlanc LLC.

(57) ABSTRACT

A firearm includes a barrel with a muzzle that defines an aim point. A front sight includes a front sight indicator. A rear sight includes a rear sight indicator. When a user extends the firearm toward a target and below a line of sight between the user and the target, the front sight indicator is visible to the user when the aim point of the firearm is above the target, the front sight indicator is not visible to the user when the aim point of the firearm is at or below the target, the rear sight indicator is visible to the user when the aim point of the firearm is below the target, and the rear sight indicator is not visible to the user when the aim point of the firearm is at or above the target.

19 Claims, 7 Drawing Sheets

FIREARM AND AN ALIGNMENT AID

FIELD OF THE INVENTION

The present disclosure generally involves a firearm and an alignment aid for the firearm.

BACKGROUND OF THE INVENTION

Many tools and other objects require a user to position or aim the tool or object in a desired direction or at a desired target during use. For example, a user must point and aim a pointer, laser, bow and arrow, handgun, shotgun, rifle, or other firearm at a desired target during use. The particular direction of aim depends solely on the relative location of the target with respect to the operator and may generally be described as the line of sight between the user and the target. For example, the user looks at the target and then positions or aims the tool or object to point along the user's line of sight to the target.

In many cases, the tool or object includes an alignment aid that assists the user to quickly and accurately aim the tool or object. For example, firearms may include a front sight and a rear sight that allow the user to aim the firearm at the target by visually lining up the front and rear sights along the user's line of sight to the target. While front and rear sights that are known can provide a geometrically accurate solution for aligning the firearm to the target along the line of sight, the sights generally require that the user place the firearm directly in the user's line of sight to the target which may undesirably obscure the user's view of the target. In addition, the physical task of visually lining up the target with the front and rear sights takes time and coordination that may not exist during a crisis or another situation that requires immediate response to a moving or stationary target. Moreover, the additional time required to visually acquire a target and visually line up the target with the front and rear sights may reduce the ability of a user to effectively operate the firearm or reduce the ability of the user to quickly acquire and engage one or more targets.

Therefore, the need exists for an improved firearm and alignment aid that may be temporarily or permanently fixed to the firearm to facilitate efficient and accurate aiming of the firearm at a desired target.

BRIEF DESCRIPTION OF THE INVENTION

Aspects and advantages of this disclosure are set forth below in the following description, or may be obvious from the description, or may be learned through practice of the invention.

One embodiment of the present invention is a firearm that includes a barrel. The barrel terminates at a muzzle and defines a longitudinal axis that extends from the muzzle coincident with an aim point of the firearm. A front sight above the barrel includes a front sight indicator. A rear sight above the barrel and further from the muzzle than the front sight includes a rear sight indicator. When a user extends the firearm toward a target and below a line of sight between the user and the target, the front sight indicator is visible to the user when the aim point of the firearm is above the target, and the front sight indicator is not visible to the user when the aim point of the firearm is at or below the target. When the user extends the firearm toward the target and below the line of sight between the user and the target, the rear sight indicator is visible to the user when the aim point of the firearm is below the target, and the rear sight indicator is not visible to the user when the aim point of the firearm is at or above the target.

Another embodiment of the present invention is a firearm that includes a barrel. The barrel terminates at a muzzle and defines a longitudinal axis that extends from the muzzle coincident with an aim point of the firearm. A front sight above the barrel includes a front sight indicator and a front sight barrier positioned with respect to the front sight indicator so that, when a user extends the firearm toward a target and below a line of sight between the user and the target, the front sight indicator is visible to the user when the aim point of the firearm is above the target, and the front sight barrier completely eclipses the front sight indicator from being visible to the user when the aim point of the firearm is at or below the target. A rear sight above the barrel and further from the muzzle than the front sight includes a rear sight indicator and a rear sight barrier positioned with respect to the rear sight indicator so that, when the user extends the firearm toward the target and below the line of sight between the user and the target, the rear sight indicator is visible to the user when the aim point of the firearm is below the target, and the rear sight barrier completely eclipses the rear sight indicator from being visible to the user when the aim point of said firearm is at or above the target.

Embodiments of the present invention also include an alignment aid for a firearm. The alignment aid includes a front sight that includes a front sight indicator and a rear sight that includes a rear sight indicator. When the front sight is attached to a distal end of the firearm and the rear sight is attached to a proximal end of the firearm, and a user extends the firearm toward a target and below a line of sight between the user and the target, the front sight indicator is visible to the user when the firearm is aimed above the target, and the front sight indicator is not visible to the user when the firearm is aimed at or below the target. In addition, in this position, the rear sight indicator is visible to the user when the firearm is aimed below the target, and the rear sight indicator is not visible to the user when the firearm is aimed at or above the target.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
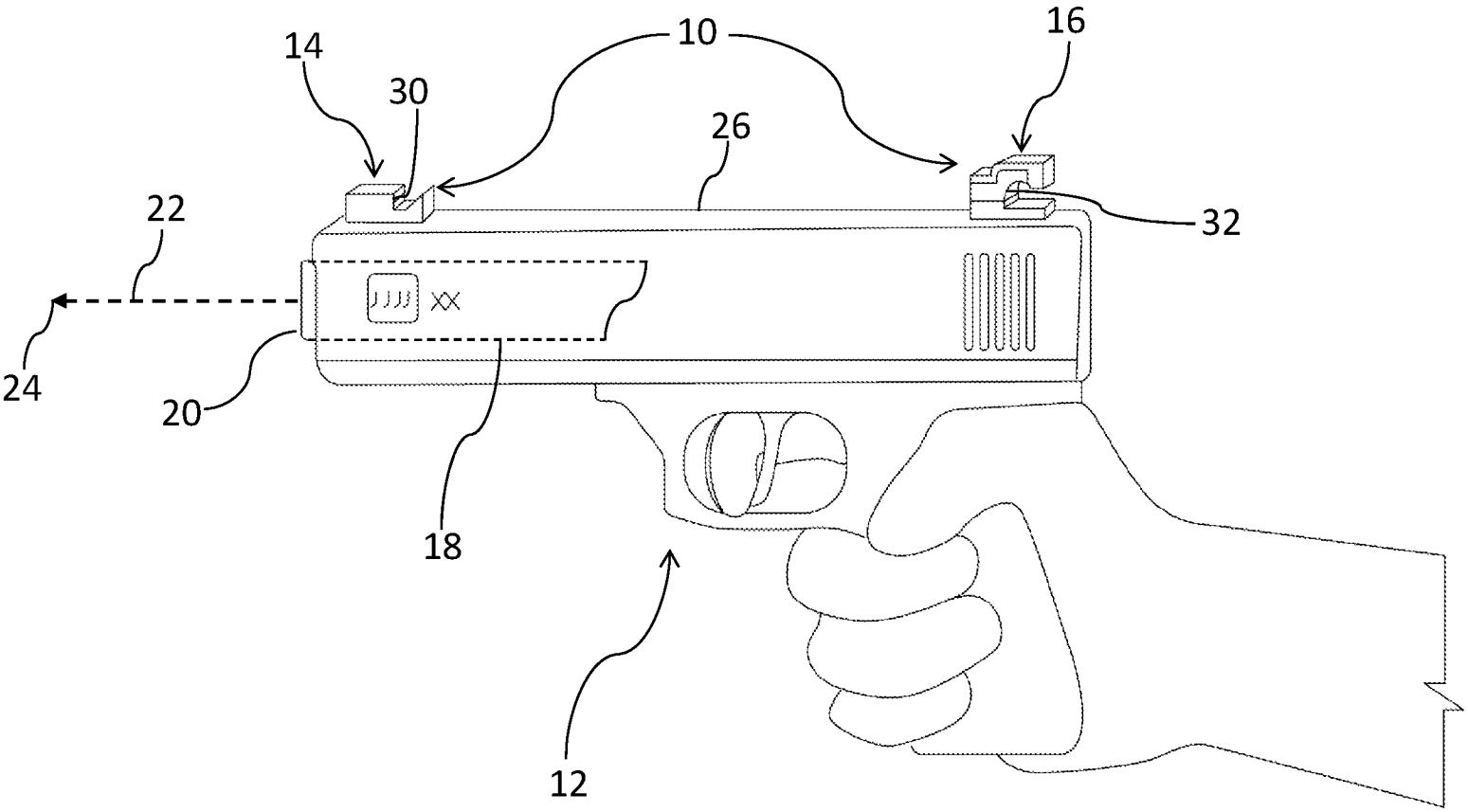
FIG. 1 is a side perspective view of a firearm with an alignment aid according to an embodiment of the present invention.

Reference will now be made in detail to example embodiments of the present disclosure, one or more examples of which are illustrated in the accompanying drawings. The detailed description uses numerical and letter designations to refer to features in the drawings. Like or similar designations in the drawings and description have been used to refer to like or similar parts of example embodiments of the present disclosure. Each example is provided by way of explanation of the present disclosure, not limitation of the present disclosure. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the term "eclipse" refers to the relative orientation of two objects with respect to a viewer in which a first object visually conceals or blocks, in whole or in part, a second object from the line of sight or field of view of the viewer. For example, during a solar eclipse the moon (the first object) conceals or blocks, in whole or in part, the sun (the second object) from the line of sight or field of view of a viewer.

Embodiments of the present invention provide an alignment aid 10 separately, or incorporated into a firearm 12, to assist a user to more accurately and/or more quickly aim the firearm 12. The alignment aid 10 generally includes a front sight 14 and a rear sight 16 that may be temporarily or permanently attached to the firearm 12. Alternately, the front and rear sights 14, 16 may be integrally incorporated into the manufacture of the firearm 12 itself, such as through molding, forging, casting, etching, or other suitable manufacturing techniques. For illustrative purposes, embodiments of the present invention will be described in the context of an alignment aid 10 for a hand gun 12. However, the present invention is not limited to any particular firearm 12 unless recited in the claims, and embodiments of the present invention may be suitably adapted for use with a rifle, shotgun, or virtually any other firearm that would benefit from faster, easier, and/or more accurate alignment with a desired target.

FIG. 1 provides a side perspective view of a firearm 12 with an alignment aid 10 according to an embodiment of the present invention. As shown in FIG. 1, the firearm 12 generally includes a barrel 18 (shown in phantom) that terminates at a muzzle 20. In this manner, the barrel 18 defines a longitudinal axis 22 that extends from the muzzle 20. As is well-known in the art, a projectile travels through the barrel 18 and out of the muzzle 20 along the longitudinal axis 22 coincident with an aim point 24 of the firearm 12. For the particular firearm 12 shown in FIG. 1, a slide 26 surrounds and encloses the barrel 18 to provide a suitable platform for the alignment aid 10, as well as other functional capability for the firearm 12 not relevant to the present invention. One of ordinary skill in the art will readily appreciate that for other firearm designs, such as a revolver, rifle, or shotgun, the alignment aid 10 may attach directly to the barrel 18 or other suitable structure, and the present invention is not limited to any particular location of the alignment aid 10 unless specifically recited in the claims.

The front and rear sights 14, 16 of the alignment aid 10 may be generally attached to the firearm 12 above the barrel 18. As with conventional sights on firearms, the front and rear sights 14, 16 are generally located toward opposite ends of the barrel 18 or slide 26, although in alternate embodiments or specific firearm designs, the front and rear sights 14, 16 may be located closer together. As shown in FIG. 1, for example, the front sight 14 may be located toward the muzzle 20 end of the firearm 12, and the rear sight 14 may be located further from the muzzle 20 than the front sight 12. The front sight 14 includes a front sight indicator 30, and the rear sight 16 includes a rear sight indicator 32. As will be explained in more detail with respect to FIGS. 6-8, the front and rear sight indicators 30, 32 assist a user to more quickly and accurately aim the firearm 12 at a desired target. Specifically, when a user extends the firearm 12 toward a target and below a line of sight between the user and the target, the front sight indicator 30 is only visible to the user when the aim point 24 of the firearm 12 is above the target, and the rear sight indicator 32 is only visible to the user when the aim point of the firearm 12 is below the target. As a result, together the front and rear sight indicators 30, 32 provide the user with a quick and accurate visual indication of the proper alignment of the firearm 12 to the intended target.

Figure 2:
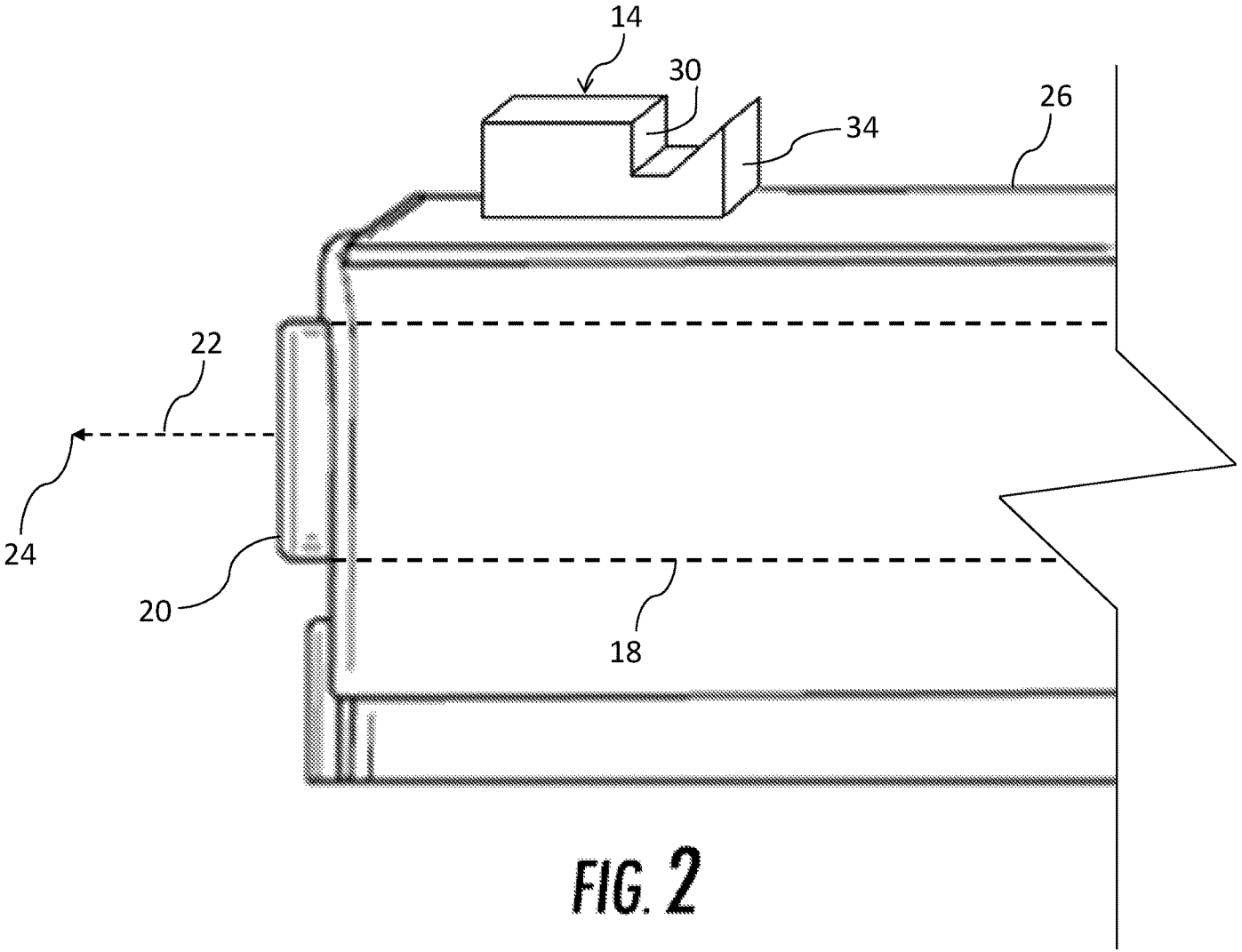
FIG. 2 is an enlarged view of a front sight of the alignment aid shown in FIG. 1.

FIG. 2 provides an enlarged view of the front sight 14 of the alignment aid 10 shown in FIG. 1. The particular size and shape of the front sight 14 may vary according to the particular firearm 12 and intended application. As shown in FIG. 2, the front sight 14 may generally include the front sight indicator 30 and a front sight barrier 34. The front sight indicator 30 and the front sight barrier 34 may simply be vertical surfaces on the front sight 14, with the front sight indicator 30 closer to the muzzle 20 than the front sight barrier 34. The height, spacing, and geometry of the front sight indicator 30 and front sight barrier 34 are selected so that the front sight indicator 30 is only visible to the user when the aim point 24 of the firearm 12 is higher than the intended target, and the front sight barrier 34 blocks the front sight indicator 30 from being seen by the user when the aim point 24 of the firearm 12 is at or below the intended target. In this manner, as will be described with respect to FIGS. 6-8, the front sight indicator 30 provides a visual indication to the user that the aim point 24 of the firearm 12 is too high, and the front sight barrier 34 completely eclipses the front sight indicator 30 from being visible to the user when the aim point 24 of the firearm 12 is at or below the target.

The front sight indicator 30 may optically contrast with at least a portion of the front sight 14 and/or front sight barrier 34. For example, the front sight barrier 34 may be painted or colored black, and the front sight indicator 30 may be painted or colored orange, red, yellow, or any other color that optically contrasts with black to provide a readily visible contrast between the front sight indicator 30 and the front sight barrier 34. Alternately, or in addition, the front sight indicator 30 and the front sight barrier 34 may be constructed of materials that optically contrast with each other or that optically contrast with other portions of the front sight 14 to enhance visibility and optically distinguish the front sight indicator 30 from the front sight barrier 34 and/or the remainder of the front sight 14. In particular embodiments, for example, the front sight barrier 34 may be constructed of aluminum, steel, carbon, fiberglass, or other suitable materials, and the front sight indicator 30 may be constructed of a fiber optic or tritium fiber optic material to enhance visibility and optically distinguish the front sight indicator 30 from the front sight barrier 34 and/or the remainder of the front sight 14.

Figure 3:
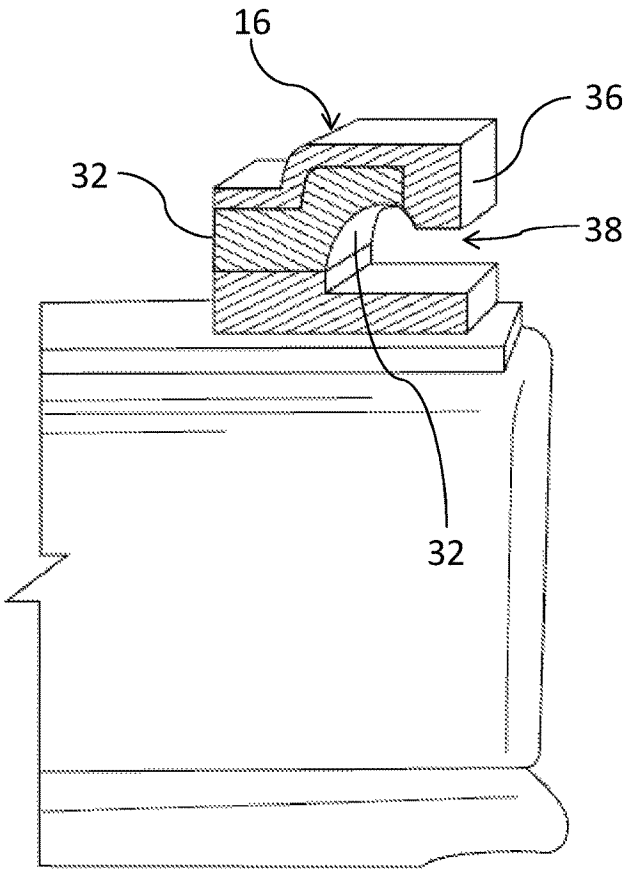
FIG. 3 is an enlarged view of a rear sight of the alignment aid shown in FIG. 1.

FIG. 3 provides an enlarged view of the rear sight 16 of the alignment aid 10 shown in FIG. 1. The particular size and shape of the rear sight 16 may vary according to the particular firearm 12 and intended application. As shown in FIG. 3, the rear sight 16 may generally include the rear sight indicator 32 and a rear sight barrier 36. The rear sight indicator 32 and the rear sight barrier 36 may simply be vertical surfaces on the rear sight 14, with the rear sight indicator 32 closer to the muzzle 20 than the rear sight barrier 36. In particular embodiments, as shown in FIG. 3, the rear sight 16 may further include a cavity 38 with the rear sight indicator 32 located inside the cavity 38. The height, spacing, and geometry of the rear sight indicator 32, rear sight barrier 36, and cavity 38 (if present) are selected so that the rear sight indicator 32 is only visible to the user when the aim point 24 of the firearm 12 is lower than the intended target, and the rear sight barrier 36 blocks the rear sight indicator 32 from being seen by the user when the aim point 24 of the firearm 12 is at or above the intended target. In this manner, as will be described with respect to FIGS. 6-8, the rear sight indicator 32 provides a visual indication to the user that the aim point 24 of the firearm 12 is too low, and the rear sight barrier 36 completely eclipses the rear sight indicator 32 from being visible to the user when the aim point 24 of the firearm 12 is at or above the target.

The rear sight indicator 32 may optically contrast with at least a portion of the rear sight 16 and/or rear sight barrier 36. For example, the rear sight barrier 36 may be painted or colored black, and the rear sight indicator 32 may be painted or colored orange, red, yellow, or any other color that optically contrasts with black to provide a readily visible contrast between the rear sight indicator 32 and the rear sight barrier 36. Alternately, or in addition, the rear sight indicator 32 and the rear sight barrier 36 may be constructed of materials that optically contrast with each other or that optically contrast with other portions of the rear sight 16 to enhance visibility and optically distinguish the rear sight indicator 32 from the rear sight barrier 36 and/or the remainder of the rear sight 16. In particular embodiments, for example, the rear sight barrier 36 may be constructed of aluminum, steel, carbon, fiberglass, or other suitable materials, and the rear sight indicator 32 may be constructed of a fiber optic or tritium fiber optic material to enhance visibility and optically distinguish the rear sight indicator 32 from the rear sight barrier 36 and/or the remainder of the rear sight 16.

Figure 5:
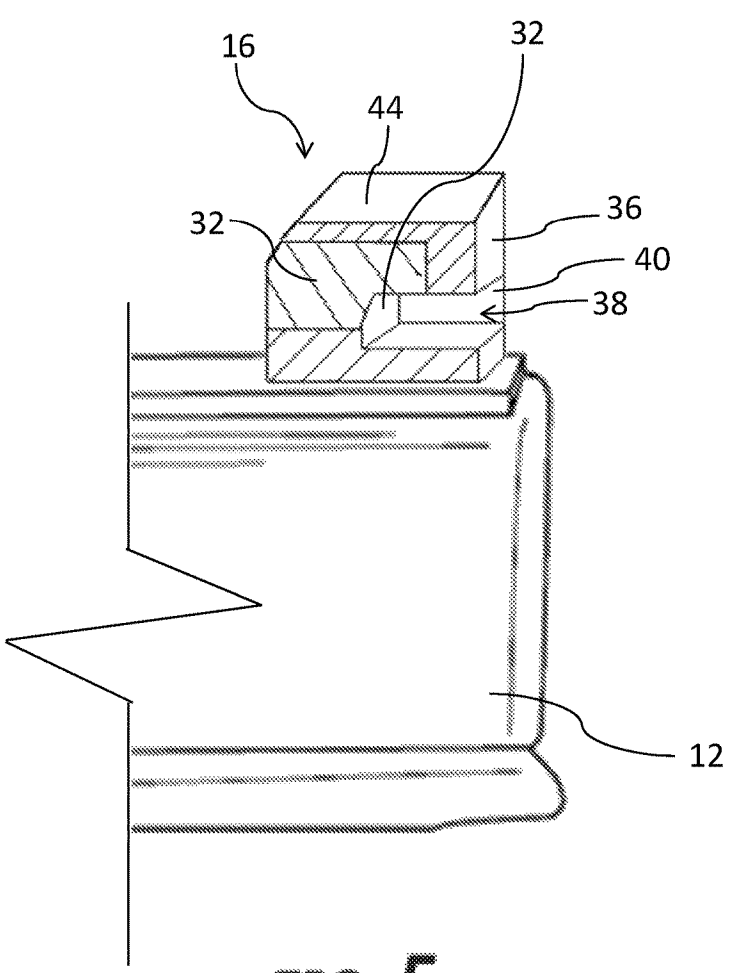
FIG. 5 is a cross-section of the rear sight of the alignment aid shown in FIG. 4 taken along line 5-5.
Figure 4:
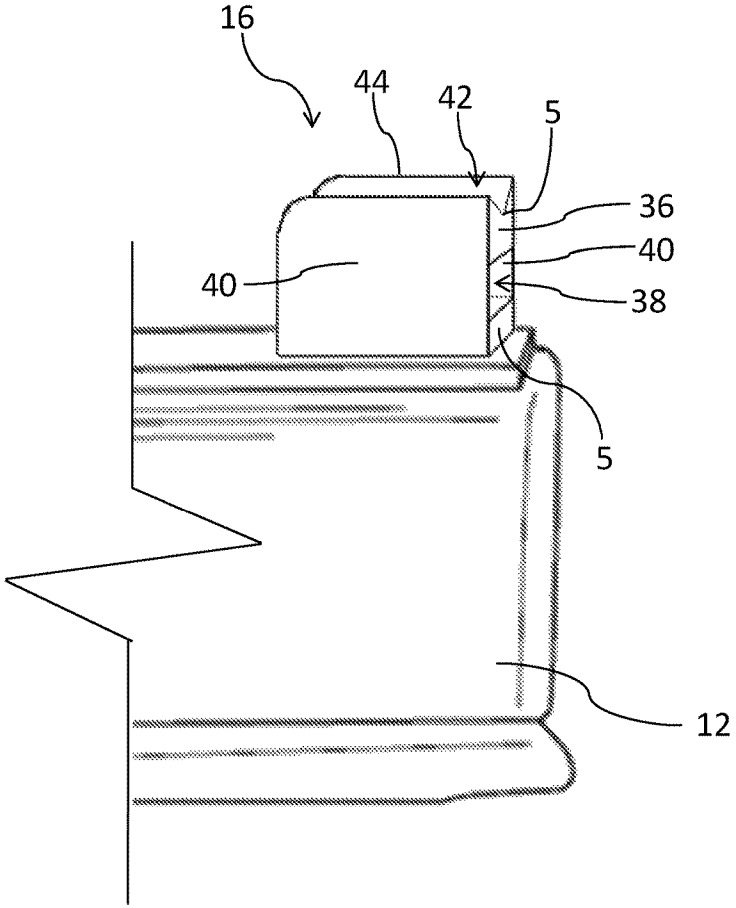
FIG. 4 is an enlarged view of a rear sight of the alignment aid according to an alternate embodiment of the present invention.

FIG. 4 provides an enlarged view of the rear sight 16 of the alignment aid 10 according to an alternate embodiment of the present invention, and FIG. 5 provides a cross-section of the rear sight 16 of the alignment aid 10 shown in FIG. 4 taken along line 5-5. The embodiment of the rear sight 16 shown in FIGS. 4 and 5 again includes the rear sight indicator 32, rear sight barrier 36, and cavity 38 as previously described and illustrated with respect to FIG. 3. In this particular embodiment, however, the rear sight 16 further includes a pair of sidewalls 40 and a groove 42. The sidewalls 40 extend along opposing sides of the rear sight 16 to further define or enclose the cavity 38 and create additional contrast between the rear sight indicator 32 and the rear sight barrier 36 or the remainder of the rear sight 16. The groove 42 extends longitudinally along a top surface 44 of the rear sight 16 to provide an additional alignment feature for the firearm 12.

Figure 6:
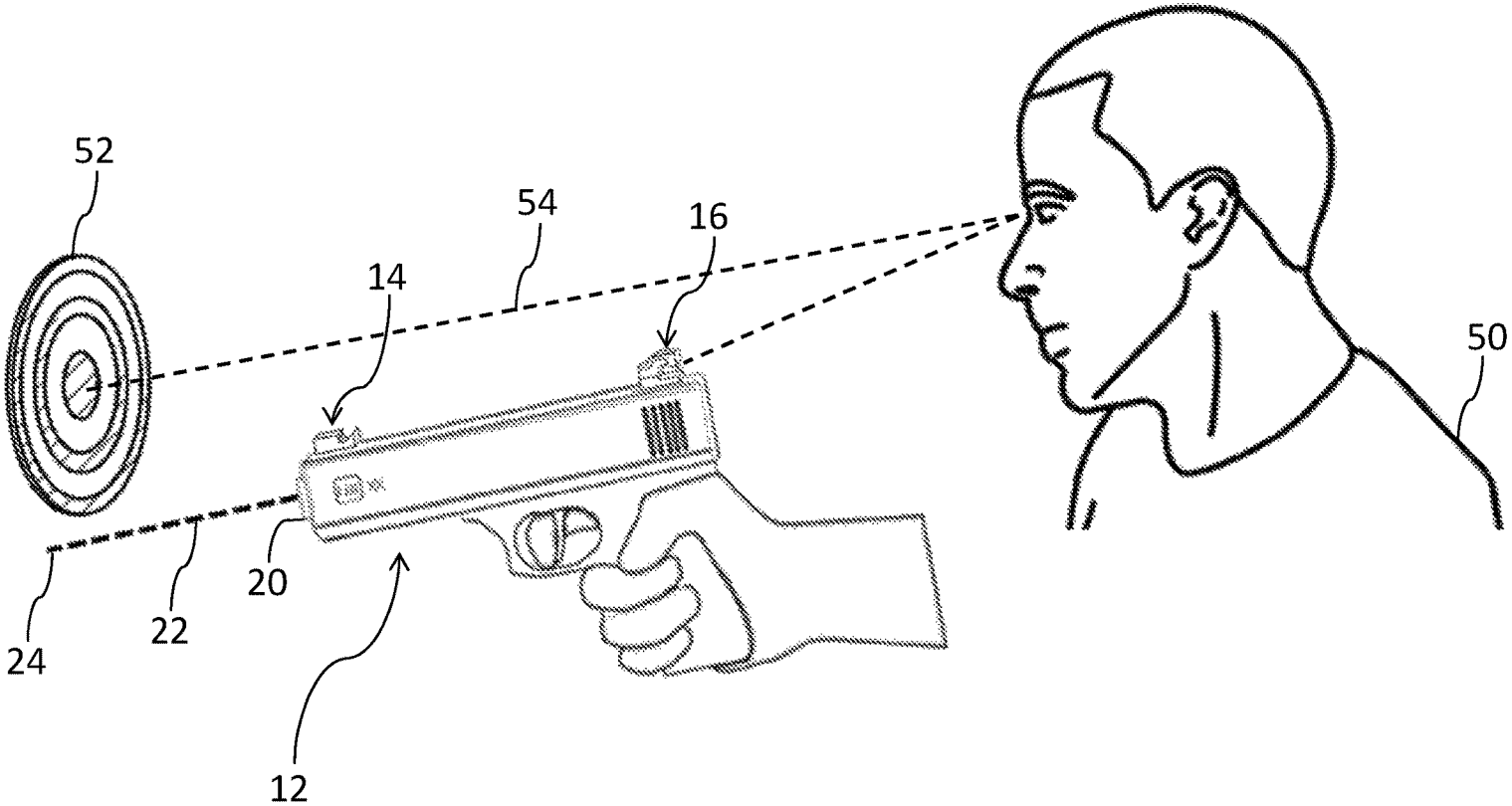
FIG. 6 illustrates the embodiment shown in FIG. 1 being aimed below a target.
Figure 7:
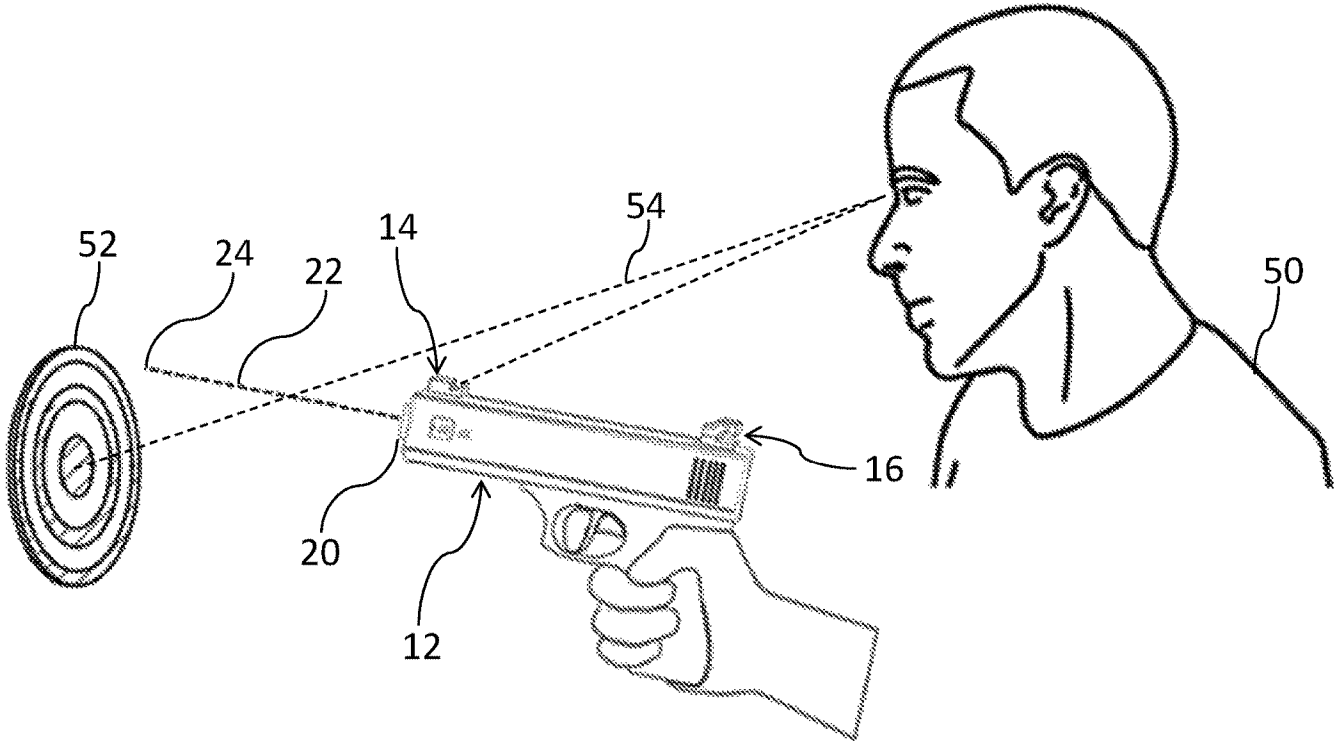
FIG. 7 illustrates the embodiment shown in FIG. 1 being aimed above a target.
Figure 8:
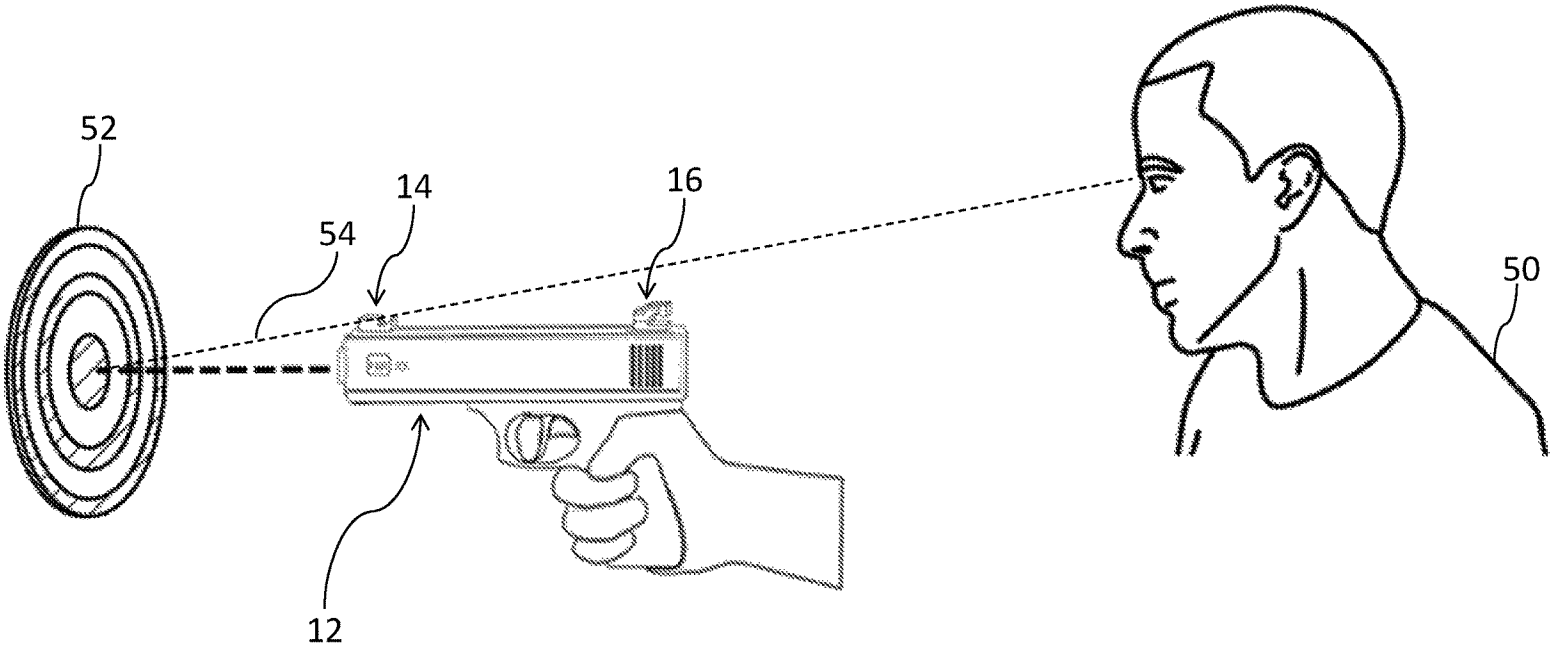
FIG. 8 illustrates the embodiment shown in FIG. 1 being aimed correctly at a target.

FIGS. 6-8 illustrate the use of the alignment aid 10 and firearm 12 shown in FIG. 1. As shown in each figure, the front sight 14 is attached to a distal end of the firearm 12, and the rear sight 16 is attached to a proximal end of the firearm 12 with respect to a user 50, and the user 50 extends the firearm 12 toward a target 52 and below a line of sight 54 between the user 50 and the target 52.

In FIG. 6, the firearm 12 is being aimed below the target 52. As a result, the front sight barrier 34 eclipses the front sight indicator 30, and the front sight indicator 30 is not visible to the user 50. In addition, the rear sight barrier 36 does not eclipse the rear sight indicator 32, and the rear sight indicator 32 is visible to the user 50. Since the user 50 can see the rear sight indicator 32 and not the front sight indicator 30, the user 50 quickly knows that the firearm 12 is aimed below the target 52.

In FIG. 7, the firearm 12 is being aimed above the target 52. As a result, the front sight barrier 34 does not eclipse the front sight indicator 30, and the front sight indicator 30 is visible to the user 50. In addition, the rear sight barrier 36 eclipses the rear sight indicator 32, and the rear sight indicator 32 is not visible to the user 50. Since the user 50 can see the front sight indicator 30 and not the rear sight indicator 32, the user 50 quickly knows that the firearm 12 is aimed above the target 52.

In FIG. 8, the firearm 12 is being aimed correctly at the target 52. As a result, the front sight barrier 34 eclipses the front sight indicator 30, and the front sight indicator 30 is not visible to the user 50. In addition, the rear sight barrier 36 eclipses the rear sight indicator 32, and the rear sight indicator 32 is not visible to the user 50. Since the user 50 cannot see either the front sight indicator 30 or the rear sight indicator 32, the user 50 quickly knows that the firearm 12 is correctly aimed at the target 52.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A firearm, comprising:

a barrel, wherein said barrel terminates at a muzzle and defines a longitudinal axis that extends from said muzzle coincident with an aim point of said firearm;

a front sight above said barrel, wherein said front sight comprises a front sight indicator;

a rear sight above said barrel and further from said muzzle than said front sight, wherein said rear sight comprises a rear sight indicator;

wherein when a user extends said firearm toward a target and below a line of sight between the user and the target, said front sight indicator is visible to the user when said aim point of said firearm is above the target, and said front sight indicator is not visible to the user when said aim point of said firearm is at or below the target, and said rear sight indicator is visible to the user when said aim point of said firearm is below the target, and said rear sight indicator is not visible to the user when said aim point of said firearm is at or above the target.

2. The firearm as in claim 1, wherein said front sight indicator optically contrasts with at least a portion of said front sight.

3. The firearm as in claim 1, wherein said front sight further comprises a front sight barrier, wherein when the user extends said firearm toward the target and below the line of sight between the user and the target, said front sight barrier completely eclipses said front sight indicator from being visible to the user when said aim point of said firearm is at or below the target.

4. The firearm as in claim 1, wherein said rear sight indicator optically contrasts with at least a portion of said rear sight.

5. The firearm as in claim 1, wherein said rear sight further comprises a cavity inside said rear sight and said rear sight indicator is inside said cavity.

6. The firearm as in claim 1, wherein said rear sight further comprises a rear sight barrier, wherein when the user extends said firearm toward the target and below the line of sight between the user and the target, said rear sight barrier completely eclipses said rear sight indicator from being visible to the user when said aim point of said firearm is at or above the target.

7. The firearm as in claim 1, wherein said rear sight further comprises a top surface, and a groove extends longitudinally along said top surface.

8. A firearm, comprising:

a barrel, wherein said barrel terminates at a muzzle and defines a longitudinal axis that extends from said muzzle coincident with an aim point of said firearm;

a front sight above said barrel, wherein said front sight comprises a front sight indicator and a front sight barrier positioned with respect to said front sight indicator so that, when a user extends said firearm toward a target and below a line of sight between the user and the target, said front sight indicator is visible to the user when said aim point of said firearm is above the target, and said front sight barrier completely eclipses said front sight indicator from being visible to the user when said aim point of said firearm is at or below the target;

a rear sight above said barrel and further from said muzzle than said front sight, wherein said rear sight comprises a rear sight indicator and a rear sight barrier positioned with respect to said rear sight indicator so that, when the user extends said firearm toward the target and below the line of sight between the user and the target, said rear sight indicator is visible to the user when said aim point of said firearm is below the target, and said rear sight barrier completely eclipses said rear sight indicator from being visible to the user when said aim point of said firearm is at or above the target.

9. The firearm as in claim 8, wherein said front sight indicator optically contrasts with at least a portion of said front sight barrier.

10. The firearm as in claim 8, wherein said rear sight indicator optically contrasts with at least a portion of said front sight barrier.

11. The firearm as in claim 8, wherein said rear sight further comprises a cavity inside said rear sight and said rear sight indicator is inside said cavity.

12. The firearm as in claim 8, wherein said rear sight further comprises a top surface, and a groove extends longitudinally along said top surface.

13. An alignment aid for a firearm, the alignment aid comprising:

a front sight, wherein said front sight comprises a front sight indicator;

a rear sight, wherein said rear sight comprises a rear sight indicator;

wherein when said front sight is attached to a distal end of the firearm and said rear sight is attached to a proximal end of the firearm, and a user extends the firearm toward a target and below a line of sight between the user and the target, said front sight indicator is visible to the user when the firearm is aimed above the target, and said front sight indicator is not visible to the user when the firearm is aimed at or below the target, and said rear sight indicator is visible to the user when the firearm is aimed below the target, and said rear sight indicator is not visible to the user when the firearm is aimed at or above the target.

14. The alignment aid as in claim 13, wherein said front sight indicator optically contrasts with at least a portion of said front sight.

15. The alignment aid as in claim 13, wherein said front sight further comprises a front sight barrier, wherein when the user extends the firearm toward the target and below the line of sight between the user and the target, said rear sight barrier completely eclipses said front sight indicator from being visible to the user when the firearm is aimed at or below the target.

16. The alignment aid as in claim 13, wherein said rear sight indicator optically contrasts with at least a portion of said rear sight.

17. The alignment aid as in claim 13, wherein said rear sight further comprises a cavity inside said rear sight and said rear sight indicator is inside said cavity.

18. The alignment aid as in claim 13, wherein said rear sight further comprises a rear sight barrier, wherein when the user extends the firearm toward the target and below the line of sight between the user and the target, said rear sight barrier completely eclipses said rear sight indicator from being visible to the user when the firearm is aimed at or above the target.

19. The alignment aid as in claim 13, wherein said rear sight further comprises a top surface, and a groove extends longitudinally along said top surface.

* * * * *